US006251144B1

(12) United States Patent
Clarkson et al.

(10) Patent No.: US 6,251,144 B1
(45) **Date of Patent: *Jun. 26, 2001**

(54) ENZYMATIC COMPOSITIONS AND METHODS FOR PRODUCING STONEWASHED LOOK ON INDIGO-DYED DENIM FABRIC AND GARMENTS

(75) Inventors: Kathleen A. Clarkson, San Francisco; Pushkaraj J. Lad, San Mateo; M. M. Mullins, Montara; Curran M. Simpson, Montara; Geoffrey L. Weiss, San Francisco; Lindsay Jacobs, San Mateo, all of CA (US)

(73) Assignee: Genencor International, Inc., Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/386,896

(22) Filed: Feb. 10, 1995

Related U.S. Application Data

(60) Division of application No. 08/159,401, filed on Nov. 30, 1993, now abandoned, which is a continuation-in-part of application No. 08/075,657, filed on Jun. 11, 1993, now abandoned, which is a continuation-in-part of application No. 07/897,721, filed on Jun. 12, 1992, now abandoned.

(51) Int. Cl.[7] ..... C11D 3/386; D06D 1/00

(52) U.S. Cl. ..... 8/401; 510/517; 510/441; 510/327; 510/320; 510/321; 510/299; 8/137; 435/263; 435/244

(58) Field of Search ..... 252/174.12, DIG. 12; 435/209, 221, 222, 263, 264; 8/401, 131; 510/517, 441, 475, 327, 320, 299, 321

(56) References Cited

U.S. PATENT DOCUMENTS

| | | | |
|---|---|---|---|
| 4,388,077 | 6/1983 | Ruck | 8/138 |
| 4,435,307 | 3/1984 | Barbesgaard et al. | 252/174.12 |

(List continued on next page.)

FOREIGN PATENT DOCUMENTS

| | | |
|---|---|---|
| 365103 | 4/1990 | (EP) . |
| 2 094 826 | 9/1982 | (GB) . |
| 2258655 | 2/1993 | (GB) . |
| 90/07569 | 7/1990 | (WO) . |
| 91/05841 | 5/1991 | (WO) . |
| 91/13136 | 9/1991 | (WO) . |
| 9117243 | * 11/1991 | (WO) . |
| 92/06183 | 4/1992 | (WO) . |
| 92/18599 | 10/1992 | (WO) . |
| 93/25655 | 12/1993 | (WO) . |
| 94/29426 | 12/1994 | (WO) . |
| 92/06209 | 4/1995 | (WO) . |

OTHER PUBLICATIONS

Innovations, "Backstaining. A Problem? Not Anymore!" 2 pages (1991).

(List continued on next page.)

*Primary Examiner*—Kery Fries
(74) *Attorney, Agent, or Firm*—Christopher L. Stone; Lynn Marcus-Wyner; Genencor International, Incorporated

(57) ABSTRACT

During the desizing and enzymatic stonewashing of denim fabric and/or garments, redeposition of blue color often occurs back onto the surfaces of the denim. The invention relates to a redepositing or backstain inhibiting composition and a method requiring the inclusion of an added protease prior to, during or subsequent to the stonewashing process which reduces the redeposition of the blue dye and hence improves the stonewashing process when using redepositing or backstaining cellulases to give an appearance closer to that when using stones alone or nonredepositing cellulases in the stonewashing process.

21 Claims, 1 Drawing Sheet

U.S. PATENT DOCUMENTS

| | | | | |
|---|---|---|---|---|
| 4,566,985 | | 1/1986 | Bruno et al. | 252/174.12 |
| 4,760,025 | | 7/1988 | Estell et al. | 435/222 |
| 4,832,864 | | 5/1989 | Olsom | 252/174.2 |
| 4,912,056 | | 3/1990 | Olsom | 435/263 |
| 5,006,126 | | 4/1991 | Olson et al. | 8/401 |
| 5,114,426 | * | 5/1992 | Milora | 8/102 |
| 5,122,159 | | 6/1992 | Olson et al. | 8/401 |
| 5,185,258 | | 2/1993 | Caldwell et al. | 435/220 |
| 5,213,581 | | 5/1993 | Olson et al. | 8/401 |
| 5,246,583 | * | 9/1993 | Clarkson et al. | 435/263 |
| 5,272,893 | * | 12/1993 | Anastase et al. | 68/16 |
| 5,333,338 | * | 8/1994 | Anastase et al. | 8/158 |
| 5,460,966 | | 10/1995 | Dixon | 435/263 |
| 5,700,686 | * | 12/1997 | Foody et al. | 435/263 |

OTHER PUBLICATIONS

Pongor, "The Use of Stuctural Profiles and Parametric Sequence comparison i n the Rational Design of Polypeptides" *Methods in Enzymology* 154:450–473 (1987).

Kochavi, et al., "Optimizing Processing conditions in Enzymatic Stonewashing" American Dyestuff Report, 79(9):24–29 (Sep. 1990).

Rothgeb, et al., "the Raw Material, Finished Products and Dust Pad Analysis of Detergent Proteases Using a Small synthetic Substrate" *JAOCS* 65(5): (1988).

* cited by examiner

ENZYMATIC COMPOSITIONS AND METHODS FOR PRODUCING STONEWASHED LOOK ON INDIGO-DYED DENIM FABRIC AND GARMENTS

This is a Divisional of application Ser. No. 08/159,401 filed Nov. 30, 1993 abandoned, which is a continuation-in-part of application Ser. No. 08/075,657 filed Jun. 11, 1993, now abandoned, which is a continuation-in-part of application Ser. No. 07/897,721 filed Jun. 12, 1992, now abandoned.

FIELD OF THE INVENTION

This invention relates to compositions and methods for reducing or preventing the backstaining of blue indigo dye onto denim during the stonewashing of denim fabric and garments utilizing cellulase enzymes.

BACKGROUND OF THE INVENTION

Denim is cotton cloth which has been dyed, usually blue, with the dye indigo. One desirable characteristic of indigo-dyed denim cloth is the alteration of dyed threads with white threads, which upon normal wear and tear gives denim a white on blue appearance. A popular look for denim is the stonewashed look. Traditionally stonewashing has been performed by laundering the denim material in the presence of pumice stone which results in fabric having a faded or worn appearance with the desired white on blue contrast appearance described above. This stonewashed look primarily consists of removal of dye in a manner to yield a material with areas which are lighter in color, while maintaining the desirable white on blue contrast, and a material which is softer in texture.

Enzymes, particularly cellulases, are currently used in processing denim. In particular cellulases have been used as a replacement for or in combination with pumice stones for the traditional "stonewashing" process used to give denim a faded look. Use of enzymes to stonewash has become increasingly popular because use of stones alone has several disadvantages. For example, stones used in the process cause wear and tear on the machinery, they cause environmental waste problems due to the grit produced and result in high labor costs associated with the manual removal of the stones from pockets of garments. Consequently, reduction or elimination of stones in the wash may be desirable.

Contrary to the use of pumice stones, enzymes (particularly cellulases) are safe for the machine, result in little or no waste problem and drastically reduce labor costs. Therefore, it may be beneficial to use enzymes for stonewashing. However, even though the use of enzymes such as cellulase may be beneficial as compared to stones alone, there are some problems associated with the use of enzymes for this purpose. For example, one problem with some cellulases, such as cellulases from Trichoderma, is what could be described as an incomplete removal of dye caused by "redeposition" or "backstaining" (both terms used interchangeably herein) of some of the dye back onto the fabric during the enzymatic stonewashing process. Such redeposition or backstaining causes blue coloration of the surface, resulting in less contrast between the blue and white threads and abrasion points (i.e., a blue on blue look rather than the preferred white on blue). See American Dyestuff Reporter, September 1990, pp. 24–28.

Redeposition or backstaining is objectionable to some users. Even though Trichoderma cellulases exhibit backstaining, they are preferable to Humicola cellulases, which do not generally exhibit backstaining, because of the higher specific activity on denim material seen with Trichoderma cellulases. In addition, cellulases with a higher degree of purity may be beneficial in the present invention. High specific activity or a high level of purity may result in a higher degree of abrasion in significantly shorter processing times and, therefore, is preferable to the denim processors.

The problem of redeposition of dye during stonewashing has been a concern of denim processors. Previous attempts to address the problem include addition of extra anti-redeposition chemicals, such as surfactants or other agents, into the cellulase wash to help disperse the loosened indigo dye and reduce redeposition. In addition, denim processors have tried using cellulases with less specific activity on denim, along with extra rinsings. This results in additional chemical costs and longer processing times. Another method attempting to address the redeposition problem includes adding a mild bleaching agent or stain removing agent in the process. This method affects the final shade of the garment and increases processing time.

While these methods aid to some limited degree in the reduction of redeposition, the methods are not entirely satisfactory and some objectionable backstaining remains. Use of enzymes and stones together may be advantageous in overcoming this redeposition problem; however, it leaves the processor with some of the problems associated with the use of stones alone.

Based on the shortcomings of previously attempted methods for reducing or preventing redeposition, there is a need for more environmentally favorable and more cost effective methods to address the issue of redeposition or backstaining of dye during stonewash treatment.

Accordingly, it would be desirable to find an enzymatic composition or method that would enhance the removal of the dye during stonewashing when redepositing or backstaining cellulases are used which, although exhibiting backstaining, have a high degree of specific activity on denim material.

FIGURES

SUMMARY OF THE INVENTION

Figure 1:
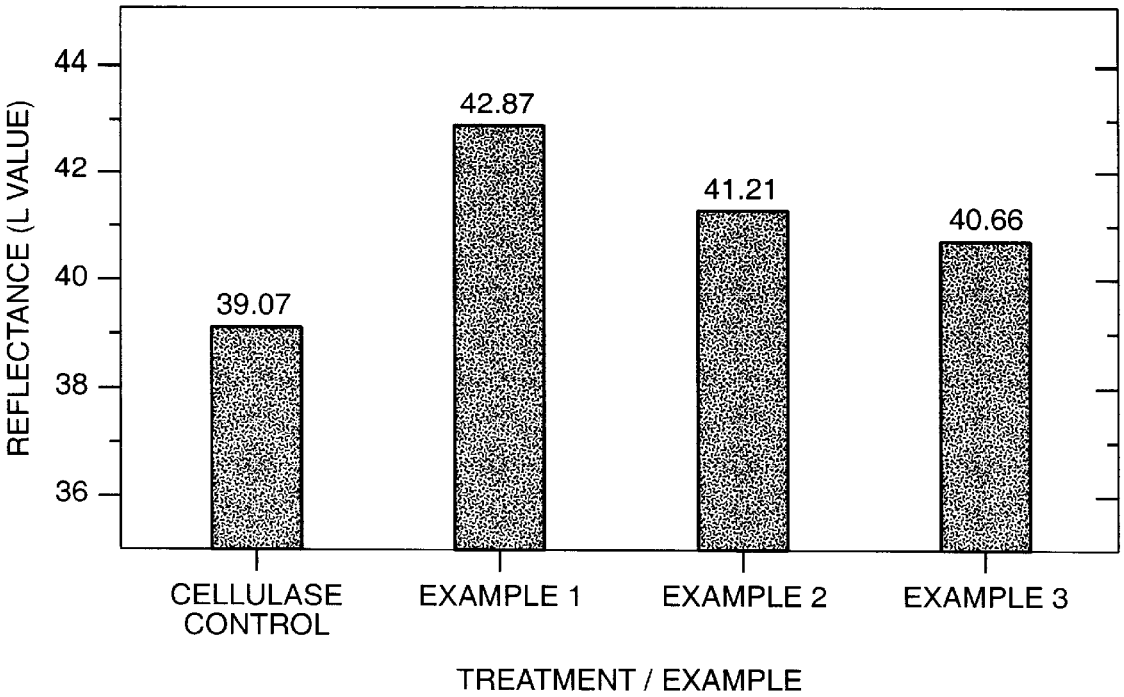
FIG. 1 shows graphics of comparative reflectance measurements of stonewashing with a redepositing cellulase and different added proteases, as described in Examples 1, 2 and 3, vs. a redepositing cellulase control.

Applicants have found that treatment of cotton indigo-dyed denim with an effective amount of a redepositing or backstain inhibiting composition comprising a redepositing cellulase composition and added protease that is in excess of the amounts naturally present in a redepositing cellulase preparation produced by a natural organism is an improvement over redepositing cellulase alone as a method for introducing variations in color density into the surface of the indigo-dyed denim. The result of treatment with such a composition is an improvement in the contrast between white and blue threads, achieving more complete dye removal (more like that achieved with pumice stones). The improvement in the contrast is due to a reduction in dye redeposition, resulting in abrasion points which are more distinct and display greater contrast between white and blue yarns, giving a superior stonewashed look. A small percentage of surface active chemical surfactant may optionally be added to the compositions or methods described herein. If a surface active agent is added, it may be added either with the cellulase and protease in the wash or with the protease as an after treatment rinse to enhance the proteolytic effect.

DETAILED DESCRIPTION OF THE INVENTION

Denim that is stonewashed with the addition of an effective amount of added protease during cellulase treatment with a redepositing cellulase shows a dramatic reduction in the level of backstaining and a visible increase in the contrast between white and blue threads, i.e., a more complete stonewash effect. While applicant does not wish to be held by any particular theory, one possible explanation for this might be that certain components present in redepositing cellulase compositions (see definition below) which comprise mixtures of several enzymes may bind tightly to the denim surface. These components may also bind dye-stained cellulose fragments and/or the dye itself, thus binding the colored materials or dye back on to the fabric. The addition of added protease effectively removes or prevents the cellulase proteins from binding the colored particles back onto the surface of the denim and yet, surprisingly, does not adversely effect the resultant abraded look caused by the action of the cellulase.

Prior to discussing this invention in further detail, the following terms will be defined.

The term "added protease" refers to an incremental amount of protease over the amount which is produced naturally by a microorganism. This incremental amount will result in reduction of backstaining when added to a redepositing cellulase composition during the stonewashing process. Preferably, such an incremental amount is at least 1% more than the amount of total protease protein naturally occurring in the microorganism that produces the redepositing cellulase composition. The amount of added protease is determined by many factors such as the purity, activity and specificity of the added protease, for example. Therefore, the incremental amount of added protease will vary with the type of protease added to the redepositing cellulase composition.

"Added protease", as used herein, may be derived from either exogenous or endogenous sources. Added exogenous protease refers to those proteases which degrade proteins that are derived or developed externally from those naturally present in the cellulase composition of the microorganism. Alternatively, the added protease may be endogenous. In this case, added endogenous proteases refers to an amount of protease in a redepositing cellulase composition that is over and above what is naturally produced by the microorganism by overexpression of the gene encoding the naturally occurring protease. The amount of enhanced protease produced by overexpressing the gene encoding the protease is an amount that will result in inhibiting or reducing backstaining in the stonewashing process. Preferably, the enhancement is at least 1% greater than the amount of protease naturally occurring in the microorganism.

Proteases are available from several sources including microbial, plant and animal sources and are well documented in the literature. Some important commercial proteolytic sources include *Bacillus licheniformis, Bacillus subtilis* and *Aspergillus oryzae*. Proteases suitable for the invention include, for example, serine, metallo and acid proteases, as well as endo- and exo-proteases. Subtilisins are serine proteases which generally act to cleave internal peptide bonds of proteins and peptides. Metallo proteases are exo- or endo-proteases which require a metal cofactor for activity. One of the preferred serine proteases is subtilisin. Particularly preferred proteases useful in the present invention are proteases obtained from a microorganism genetically modified as described in U.S. Pat. Nos. 4,760,025 and 5,185,258, each of which is incorporated herein by reference.

The term "cellulase composition" comprises one or more exo-cellobiohydrolase (CBH), endogluconase (EG) and β-glucosidase (BG) components produced by a naturally occurring microorganism, wherein each of these components is found at the ratio naturally produced by the microorganism and sometimes referred to herein as a "complete or natural cellulase composition."

It is contemplated that the cellulase compositions of the present invention may also include a cellulase composition obtained from a microorganism genetically modified so as to overproduce, underproduce or not produce one or more of the CBH, EG and/or BG components of cellulase. Additional modified cellulase compositions may include truncated cellulase proteins comprising either the binding domain or the core domain of the CBHs or EGs, or a portion or derivative thereof. Other examples of modified cellulase compositions may include alterations in the degree of glycosalation, or substitution(s) of amino acid(s) of the primary sequence of the cellulases or truncated cellulases.

A "redepositing or backstaining cellulase" as used herein refers to those cellulases, for example Trichoderma, which in the enzymatic stonewashing of denim tend to backstain the fabric leading to incomplete stonewashing when compared with stones alone or to cellulases which do not backstain, such as from Humicola. Redepositing or backstaining cellulases are derived from microorganisms such as fungal microorganism Trichoderma sp. or any other microorganism that produce cellulases displaying a backstaining or redepositing effect on denim in the stonewashing process.

The methods of the present invention comprise contacting the denim to be partially or wholly enzymatically stonewashed with an added protease in an amount sufficient to reduce backstaining and thus, to increase the contrast between blue and white fibers. The protease may be mixed together with the cellulase and then added to the wash containing the indigo-dyed denim fabric or each can be added separately and directly to the wash or the protease may be added subsequent to the cellulase wash in the rinse cycle. Alternatively, the protease may be added to the wash cycle prior to the addition of the cellulase to the same wash cycle. It should be noted that the cellulase stonewash bath may or may not include the liquor from the previous desizing step.

The redepositing or backstain inhibiting compositions of the present invention comprise added protease(s) and redepositing cellulase(s). In a particular embodiment, the redepositing or backstain inhibiting composition of the present invention comprises a redepositing or backstaining cellulase and added protease in a ratio of from about 5 ppm total protein in the redepositing cellulase: 1,000 ppm total protein in the added protease to 1,000 ppm total protein in the redepositing cellulase: 1 ppm total protein in the added protease. In a more preferred embodiment, the ratio is from about 10 ppm total protein in the redepositing cellulase: 200 ppm total protein in the added protease to 200 ppm total protein in the redepositing cellulase: 1 ppm total protein in the added protease. Total cellulase and protease protein can be measured by various assay methods known in the art. The assay preferably used herein is a commercially available biuret Lowry assay sold by Sigma Company, using bovine serum albumin (BSA) as the reference standard.

The redepositing or backstain inhibiting compositions may further comprise various adjuvants as known to those skilled in the art. For example, a surfactant (anionic or nonionic) compatible with the redepositing cellulase and added protease would be useful in the compositions of the present invention. Preferable surfactants are nonionic, such as the polyoxyethylated alcohols found in the TRITON® series of surfactants (octylphenoxypolyethoxyethanol nonionic surfactants) which are commercially available from Union Carbide. See, for example, U.S. Pat. No. 5,006,126 for a sample of these compatible surfactants. It should be noted that inclusion of a surfactant may further increase the stonewashing effect in combination with the redepositing cellulase and added protease. Other materials can also be used with or placed in the composition as desired, including stones, fillers, solvents, buffers, pH control agents, enzyme activators, builders, enzyme stabilizers, other antiredeposition agents and the like.

The backstain inhibiting composition may be formulated as a solid product wherein the solid may be granular, spray dried or agglomerated. For example, enzyme containing granules wherein the layer may comprise one or more enzymes including cellulases, proteases, amylases, and other proteins as recited in U.S. Ser. No. 07/957,973 filed on Oct. 7, 1992 which is a continuation in part of U.S. Ser. No. 07/772,510 filed on Oct. 7, 1991. These applications are incorporated herein by reference in its entirety. One contemplated application for a particle coated with cellulase, protease and amylase is to combine the desizing and stonewashing treatment in a single wash cycle.

Alternatively, the backstain inhibiting compositions may be formulated as a liquid gel or paste product. In this particular embodiment, redepositing cellulase is mixed with added protease in a ratio of from about 5 ppm total protein in the redepositing cellulase: 1,000 ppm total protein in the added protease to 1,000 ppm total protein in the redepositing cellulase: 1 ppm total protein in the added protease. To prepare a stable aqueous preparation of the above mixture, stabilizing ingredients must also be adding comprising oxygen containing, water soluble organic solvents in a buffer ranging from pH 4–6. Preferably sorbitol and glycerol are the stabilizing ingredients of choice.

In a preferred embodiment, the above liquid formulation mixture is incubated at elevated temperatures ranging from about 30° C. to about 60° C. from about 1 hour to 2 weeks prior to application on the denim fabric. In the most preferred embodiment, a temperature of about 37° C. and incubation time of about 120 hours are employed. One skilled in the art will recognize the amount of time for incubation which depends on the temperature chosen to prepare the mixture. It is further contemplated that the pretreated liquid formulation may be converted to a solid, i.e. granular, form to preserve the stability of the composition.

Added proteases used in the present invention may be added together with the redepositing cellulase to the stonewashing bath, or each added separately to the stonewash cellulase bath. Alternatively, the protease may be added in a separate cycle either prior to the cellulase bath or in a subsequent rinse treatment solution. In all methods contemplated above, the redeposition is reduced by about 5%, preferably about 10%, via measurement of reflectance off the backside of treated garments when compared to the stonewashing with cellulase alone. The measurement of reflectance values is described more fully in the Experimental section of this application. It should be noted, however, that the values measured for reflectance are compressed as compared to the visual differences seen when comparing treated versus untreated fabric. Visual observation is a more sensitive indicator of the stonewashing effect. Thus, visual observation of the backstaining on the backside of the garment reveals greater differences between treated and untreated fabric, as compared to measurements determined by a reflectometer.

In an embodiment of the present invention, the redepositing cellulase and added protease are present in a ratio of from about 5 ppm total protein in the redepositing cellulase: 1,000 ppm total protein in the added protease to 1,000 ppm total protein in the redepositing cellulase: 1 ppm total protein in the added protease. In a more preferred embodiment, the ratio is from about 10 ppm total protein in the redepositing cellulase: 200 ppm total protein in the added protease to 200 ppm total protein in the redepositing cellulase: 1 ppm total protein in the added protease.

One skilled in the art will realize that the effective amount of added protease will vary depending upon a number of well understood parameters, including the amount and purity of redepositing cellulase used, as well as the amount of redeposition which occurs without protease, the contact time, the amount of dye removed during stonewashing, the specific activity of the redepositing cellulase and/or added protease, the pH and temperature of the stonewashing process, the formulation of the product (liquid versus granular) and the like. It is well known in the art that specific activity of added protease and/or redepositing cellulase can be modified by genetically engineering a strain to change or modify components of interest. For example, the overexpression of certain cellulase components is demonstrated in U.S. application Ser. No. 07/770,049, which is incorporated herein by reference. Protein engineering techniques can also be used to modify enzyme activity or specificity, see for example U.S. Pat. No. 4,760,025, which is incorporated herein by reference.

It will be a simple matter to titrate the added protease with several washings and visually observe the resultant denim samples to achieve an effective amount which results in a reduction in backstaining. It should be noted, however, that there is a balance between the proteolytic effect on reducing backstaining and the proteolytic effect on reducing abrasion. One must find the optimum ratio of redepositing cellulase to added protease to achieve the antiredeposition effect without adversely affecting abrasion.

Reflectance values can be used as well to track the degree of redeposition on the backside of the garment but do not accurately reflect the contrast between fibers on the abraded front side of the garments. Differences in redeposition determined visually are more pronounced than with reflectance values, but reflectance values do show the effect to a lesser extent.

Redepositing or backstain inhibiting compositions of the present invention for addition to denim stonewash solutions (either as a solid or liquid) while comprising a redepositing cellulase(s) and added protease(s), may further comprise other adjuvants, such as surfactants, fillers, dispersants, buffers or pH control agents, enzyme activators, builders, enzyme stabilizers or other antiredeposition ingredients. One skilled in the art can readily compare the results of various combinations and ratios of solutions to optimize the selected components of such compositions. However, applicants have found that depending on the type of enzymes used and the particular mixture of selected ingredients mentioned above, the range of enzyme ingredients will preferably be within a ratio of from about 5 ppm total protein in the redepositing cellulase: 1,000 ppm total protein in the added protease to 1,000 ppm total protein in the redepositing cellulase: 1 ppm total protein in the added protease, as previously defined. In a more preferred embodiment, the ratio is from about 10 ppm total protein in the redepositing cellulase: 200 ppm total protein in the added protease to 200 ppm total protein in the redepositing cellulase: 1 ppm total protein in the added protease. This ratio will accommodate various combinations of specific activity of both redepositing cellulase and added protease, from both high specific activity to both low to variations in between, where one enzyme is relatively high in specific activity and the other relatively low. In addition, this ratio will accommodate various combinations of different purity of enzymes, from both highly pure to both having low purity to variations in between where one enzyme is relatively pure and the other has relatively low purity.

Where a surfactant is included in the composition, it will be about 5–85% of the total weight of either the liquid or dry composition. However, based on the Examples, one skilled in the art may lower the concentration of surfactant to amounts below 5% of the total weight of the liquid or dry composition without departing from the scope of the present invention. It is also possible to add the components separately, all at once, or sequentially (including separate rinse cycles). The amount of composition to use to treat denim would depend on the amount of enzymes active on the denim substrate and their specific activity on that substrate, the desired amount of stonewash effect and other parameters within the skill in the art.

The following examples are illustrative of the effectiveness of the compositions and processes of the present invention and are not intended to be limiting. Other choices of added protease or redepositing cellulase, as well as wash conditions such as concentration, measurement, pH, temperature and the like, will be evident to those skilled in the art based on the teachings herein.

EXPERIMENTAL

EXAMPLE 1

A 50 lb. Unimac dye/washing machine was used. Approximately 10 lbs. (~3.8 kgs.) of desized test denim garments were placed in the machine. The machine was filled with 10 gals. (38 L) hot water and brought to 131° F. (55° C.). The liquor ratio was 10:1 (kg. garment:liters liquor). The liquor was buffered to Ph ~4.9 with 44 grams citric acid, monohydrate, and 100 grams sodium phosphate dibasic.

Once pH was established, redepositing cellulase enzyme INDIAGE® 44 L (Trichoderma cellulase composition, commercially available from Genencor International, Inc.) was added at a rate of about 0.5 ml of product/L of wash liquor (62.5 ppm total protein). Protease enzyme, GC899 (a serine endopeptidase from *Bacillus subtilis,* available from Genencor International, Inc.) was then added at about 2.5 ml of product/L of wash liquor (163 ppm total protein). This resulted in a dose ratio of about 1:2.6 based on total protein. The garments were washed at 36 rpms for 60 minutes. After this, the bath was dropped.

The garments were then rinsed according to a standardized protocol in three consecutive cycles of clean liquor. Rinse #1=24 gals. hot water, approximately 50° C., plus ~100 grams standard detergent WOB (from American Association of Textile Chemists and Colorists [AATCC], WOB= without brighteners). Agitation was for 12 minutes at 36 rpms. The bath was dropped. Rinse #2=24 gals. warm water, ~40° C., with no additional detergents, agitated for 5 minutes. The bath was dropped. Rinse #3=24 gals. cold water, ~30° C., with no additional detergents, agitated for 5 minutes. The bath was dropped. Garments were extracted and dried in a standard electric clothes dryer.

Reflectance readings were taken off the backside of the garments using a Hunter Color Difference Meter (reflectometer apparatus). Reflectance was measured as the percent reflectance (or transmittance of light off treated fabric) where L=100 units is white, and L=0 units is black. Compared to redepositing cellulase treatment only (redepositing cellulase control=0.5 ml of INDIAGE® 44 L product/L wash liquor), the redepositing cellulase plus added protease treated garments resulted in significantly reduced backstaining with similar levels of abrasion (39.07 [redepositing cellulase control] vs. 42.87 [redepositing cellulase and added protease] reflectance values). These reflectance values confirmed visual observations. The added protease treatment resulted in a better abraded contrast overall. See FIG. 1.

EXAMPLE 2

This test was substantially similar to Example 1 with the same type and amount of redepositing cellulase being used but with a different amount of the same added protease. This was about 0.5 ml of product/L of wash liquor (33 ppm total protein) of the added protease. This resulted in a dose ratio of about 1:0.5 based on total protein. All other processing parameters were the same.

Compared to redepositing cellulase control, reflectance readings were significantly different between the two treatments, but level of abrasion was not. Cellulase control= 39.07 vs. cellulase and protease=41.21. The final abraded look had better contrast for the added protease treated garments as compared to untreated (no protease) control, however, added protease treatment in Example 1 was better than Example 2, showing the titration effect of added protease. See FIG. 1.

EXAMPLE 3

The redepositing cellulase treatment was the same as in Example 1 but without the addition of added protease. The bath was dropped and the standard rinse cycle was begun, as described in Example 1 with the following exception: 1 ml of GC899 protease per liter of rinse liquor was added at the beginning of Rinse #1. A total of 100 mls of added protease product was used (65 ppm total protein). All other conditions remained the same.

Use of the added protease with detergent in the rinse cycle resulted in significantly reduced backstaining when compared to cellulase control rinsed with detergent alone. Reflectance values were 40.66 for the added protease rinse vs. 39.07 for the standard rinse without added protease. The degree of abrasion was the same for both treatments, although the added protease rinsed garments showed better overall contrast than the standard rinse without added protease. See FIG. 1.

EXAMPLE 4

Utilizing the cellulase washing protocol described in Example 1, the following added protease products were tested, along with 0.5 ml of product/L of wash liquor of redepositing cellulase enzyme (62.5 ppm total protein) INDIAGE® 44 L (Trichoderma cellulase composition, commercially available from Genencor International, Inc.):

1. MULTIFECT™ P64 (bacterial protease derived from *Bacillus licheniformis* and commercially available from Genencor International, Inc.), dosed at about 5 g of product/L of wash liquor (71 ppm total protein) to yield a dose ratio of about 1:1 based on total protein;
2. MULTIFECT™ P53 (bacterial protease derived from *Bacillus subtilis* and commercially available from Genencor International, Inc.), dosed at about 5 g of product/L of wash liquor (88 ppm total protein) to yield a dose ratio of about 1:1.5 based on total protein;
3. MULTIFECT™ P41 (fungal protease derived from *Aspergillus orvzae* and commercially available from Genencor International, Inc.), dosed at about 5 g of product/L of wash liquor (172 ppm total protein) to yield a dose ratio of about 1:2.75 based on total protein;
4. Subtilisin GC399 (available from Genencor International, Inc.), dosed at about 2.5 g of product/L of wash liquor (238 ppm total protein) to yield a dose ratio of about 1:4 based on total protein.

Figure 2:
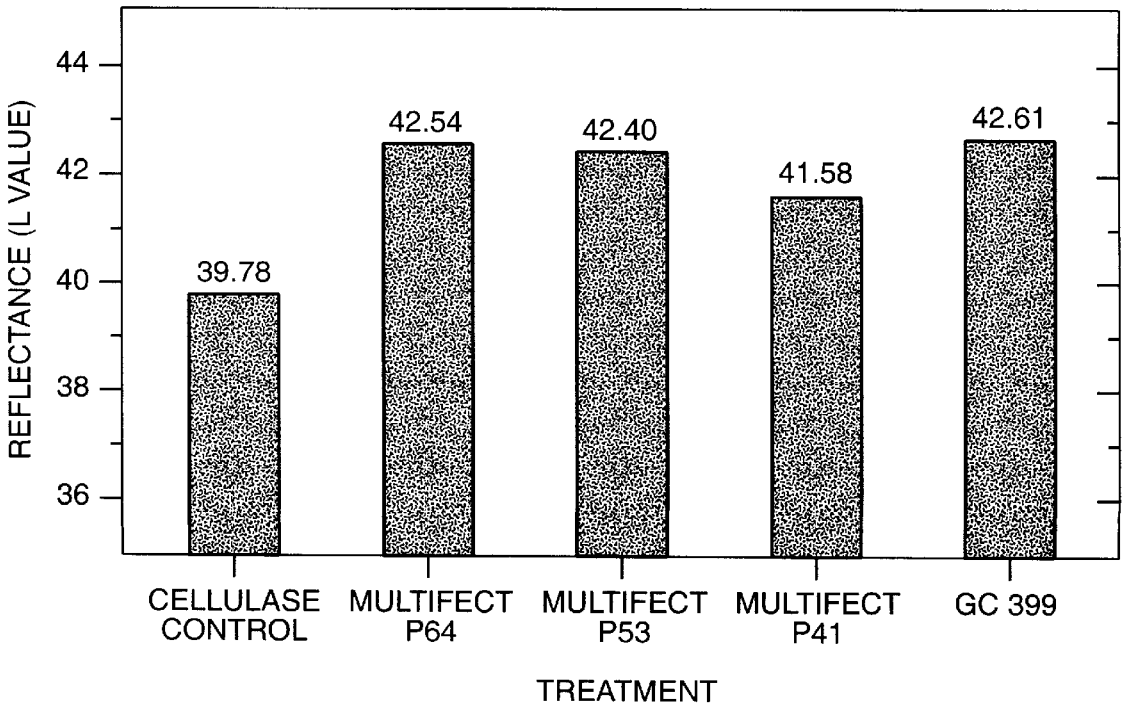
FIG. 2 shows graphics of comparative reflectance measurements of stonewashing with a redepositing cellulase and different added proteases vs. a redepositing cellulase control, as exemplified in Example 4.

All added protease treatments resulted in less redeposition with similar abrasion levels when compared to redepositing cellulase control garments. In each case, added protease treatment improved overall contrast of the abraded look. See FIG. 2. This example shows the effect of added proteases from various microbial sources which show the same antiredeposition effect as the added protease used in the previous examples.

EXAMPLE 5

A series of cellulase washes were run in order to demonstrate the efficacy of added protease protein per se as opposed to the formulation components of the added protease product in reducing the degree of redeposition. GC899 protease protein was used, which contained no enzyme product formulation components other than the protease protein. The same cellulase washing procedure was used as described in Example 1.

The following treatments were run:

1. Buffer Control (no protease or cellulase).
2. Redepositing Cellulase Control=0.5 ml of product/L wash liquor (62.5 ppm total protein) dose of INDIAGE® 44 L (Trichoderma cellulase composition, commercially available from Genencor International, Inc.).
3. Nonredepositing Cellulase Control=2.5 ml of product/L wash liquor (100 ppm total protein) dose of DENIMAX™ L (endoglucanase derived from Humicola, a non-pathogenic mold and commercially available from Novo Nordisk). This was the recommended dose of the manufacturer.
4. Added Protease Treatment=0.5 ml of product/L wash liquor (62.5 ppm total protein) dose of INDIAGE® 44 L (Trichoderma cellulase composition, commercially available from Genencor International, Inc.) plus about 0.18 mls of GC899 protease protein/L wash liquor (25 ppm total protein). This resulted in a dose ratio of about 1:0.4 based on total protein.

All treatments were run at Ph 5 except for the nonredepositing cellulase treatment, which was run at Ph 7 according to the manufacturer's recommendations. The reflectance readings are shown in the following Table 1:

TABLE I

| TREATMENT | REFLECTANCE (L VALUE) |
|---|---|
| Buffer Control | 43.25 |
| Redepositing Cellulase Control | 37.92 |
| Nonredepositing Cellulase Control | 42.60 |
| Added Protease Treatment | 43.51 |

Reflectance results correspond with visual observations that the addition of protease protein reduces the degree of redeposition on garments. The protease treated garments have similar reflectance readings to a nonredepositing cellulase treatment. Quality of abraded contrast is improved with protease treatment as well over redepositing cellulase treatment.

EXAMPLE 6

Use of added protease in combination with a surfactant, either added separately with the redepositing cellulase or added as a redeposit inhibiting composition is demonstrated in the following treatments. Again, the same cellulase washing protocol was used for all cases, as described in Example 1.

1. Buffer Control (no protease or cellulase).
2. Redepositing Cellulase Control=0.5 ml of product/L of wash liquor (100 ppm total protein) dose of a redepositing cellulase, CELLUSOFT™L (Trichoderma cellulase preparation, commercially available from Novo Nordisk), plus 0.25 ml of product/L of wash liquor (250 ppm) dose of nonionic surfactant, TRITON® X-100 (octylphenoxypolyethoxyethanol nonionic surfactant, commercially available from Union Carbide Chemicals and Plastics Co., Inc.).
3. Added Protease/Surfactant Treatment=0.5 ml of product/L of wash liquor (100 ppm total protein) dose of a redepositing cellulase, CELLUSOFT™L (Trichoderma cellulase preparation, commercially available from Novo Nordisk), plus 0.25 ml of product/L of wash liquor (250 ppm) dose of nonionic surfactant, TRITON® X-100 (octylphenoxypolyethoxyethanol nonionic surfactant, commercially available from Union Carbide), plus about 0.2 mls of GC899 protease protein/L wash liquor (40 ppm total protein). this resulted in a dose ratio of about 1:0.4 based on total protein.
4. Nonredepositing Cellulase Control=2.5 ml of product/L of wash liquor (100 ppm total protein) dose of DENIMAX™ L (endoglucanase derived from Humicola, a non-pathogenic mold and commercially available from Novo Nordisk).
5. Backstain Inhibiting Composition Blend=a blend comprising of redepositing Trichoderma cellulase (from Genencor International, Inc.), subtilisin protease (GC399 from Genencor International, Inc.) and nonionic surfactant (TRITON® X-120, octylphenoxypolyethoxyethanol nonionic surfactant, commercially available from Union Carbide) was dosed at 2 g of blend/L of wash liquor. This is about a 1:0.4 ratio of cellulase to protease protein as defined previously. This dose of the blended product resulted in doses of 60 ppm total protein from the cellulose product, 24 ppm total protein from the protease product and 120 ppm surfactant. The blend was made up of 3% total protein from the cellulase, 1.2% total protein from the protease and 6% of the surfactant.

TABLE II

| TREATMENT | REFLECTANCE (L VALUE) |
|---|---|
| Buffer Control | 43.25 |
| Redepositing Cellulase Control | 35.65 |
| Protease/Surfactant Treatment | 42.48 |
| Nonredepositing Cellulase Control | 42.60 |
| Backstain Inhibiting Composition Blend | 42.33 |

As can be seen, the addition of protease to a redepositing cellulase in the presence of surfactant, either as separate components added altogether (protease/surfactant treatment), or as a single backstain inhibiting composition (backstain inhibiting composition blend), markedly reduces the degree of redeposition. Reflectance values of protease treatments are similar to those of a nonredepositing cellulase or buffer treatment. Visual observations confirm this. The contrast of the abraded look is also improved with protease treatment which is better than treatment with the redepositing cellulase control.

EXAMPLE 7

The test was performed in a substantially similar manner as Example 1, except that the protease and redepositing cellulase are mixed together prior to the addition in the wash cycle. The mixture, INDIAGE 44 L and Protease GC899 is prepared in a ratio of about 10:1 based on total protein. In this example, the amount is about 111 ppm total protein. Once the pH of the washing liquid was established, the redepositing cellulase and protease mixture was added at a concentration of about 1.0 ml of mixture/L of wash liquid. All other processing parameters were the same as Example 1 except that a different lot of denim was employed in this Example and Example 8 below.

Compared to the redepositing cellulase control, reflectance readings of the sample treated with redepositing cellulase/protease were significantly different. Reflectance results correspond with the visual observation that the addition of protease protein in the mixture reduces the degree of redeposition on the denim garments compared to the redepositing cellulase control. The protease treated garments show similar reflectance readings to a non-depositing cellulase treatment. The quality of abraded contrast in the fabric was also improved with the redepositing cellulase/protease mixture compared to the redepositing cellulase alone. See Table III below.

EXAMPLE 8

The test was performed in a similar manner as Example 7 using the same redepositing cellulase and protease mixture, however, the ratio of cellulase to protease was changed and an additional heating process was included.

The mixture comprising INDIAGE 44 L and Protease GC899 was prepared in a ratio of about 60:1 based on total protein. The mixture was further heated to a temperature of 37° C. for 120 hours before addition to the wash cycle. In this example, the amount is about 122 ppm total protein. All other processing parameters were the same as those described in Examples 1 and 7.

TABLE III

| TREATMENT | REFLECTANCE (L VALUE) |
|---|---|
| Redepositing Cellulase Control | 45.08 |
| Redepositing Cellulase/Protease Mixture (Example 7) | 52.58 |
| Redepositing Cellulase/Protease Mixture Heat Treatment (Example 8) | 52.53 |
| Nonredepositing Cellulase Control | 51.86 |

Similar to results in Example 7 where garments are treated with a redepositing cellulase/protease mixture, treating garments with the redepositing cellulase/protease mixture that has been previously heated results in improved reduction of backstaining compared to the garments treated with redepositing cellulase alone. Moreover, the contrast of the abraded look is markedly improved using the pre-incubated cellulase/protease mixture compared to the redepositing cellulase control and the redepositing cellulase/protease mixture of Example 7.

What is claimed:

1. An improved method for introducing into the surface of indigo-dyed denim, localized areas of variation in color density and a high contrast between blue and white fibers of the denim, said method comprising laundering a denim material in the presence of pumice stone or an equivalent abrasive substance, wherein the improvement comprises, at a step in said method during which said pumice stones or an equivalent abrasive substance is added to achieve a stone-washed appearance, substituting for or adding to said pumice stones or equivalent abrasive substance by contacting the denim with:

a. an effective amount of a redepositing cellulase sufficient to produce the variations in color density; and b. an effective amount of an added protease sufficient to reduce backstaining and increase the contrast between blue and white fibers in any order.

2. The method according to claim 1 wherein the effective amount of cellulase and protease is a ratio from about 5 ppm total redepositing cellulase protein: 1,000 ppm total added protease protein to 1,000 ppm total redepositing cellulase protein: 1 ppm total added protease protein.

3. The method according to claim 1 wherein said added protease is a serine or metallo protease.

4. The method according to claim 1 wherein the protease is from Bacillus or Aspergillus.

5. The method according to claim 1 further comprising the addition of a surfactant in an amount sufficient to further increase the removal of redeposited indigo dye.

6. The method according to claim 1 wherein the protease contacts the denim in a separate treatment water after the cellulase treatment.

7. The method according to claim 1 wherein the redepositing cellulase is from Trichoderma.

8. The method according to claim 1 wherein said added protease or said redepositing cellulase has been modified by genetic engineering to yield a strain which overexpresses particular components of the protease or cellulase or is deleted for specific components.

9. The method according to claim 1 wherein said added protease or said redepositing cellulase has been modified by protein engineering to yield protease or cellulase enzymes having altered properties such as enzyme activity or specificity.

10. The method according to claim 1 further comprising contacting the denim with pumice stones.

11. The method according to claim 3 wherein said serine protease is a subtilisin.

12. An improved method for introducing into the surface of indigo-dyed denim localized areas of variation in color density and a high contrast between blue and white fibers of the denim, said method comprising laundering a denim material in the presence of pumice stone or an equivalent abrasive substance, wherein the improvement comprises, at a step in said method during which said pumice stones or an equivalent abrasive substance is added to achieve a stonewashed appearance, substituting for or adding to said pumice stones or equivalent abrasive substance by contacting the denim with an effective amount of the composition comprising a redepositing cellulase and an added protease wherein the ratio of total protein in the redepositing cellulase to total protein in the added protease is from about 5 ppm: 1,000 ppm to 1,000 ppm: 1 ppm and wherein said redepositing cellulase and said protease are mixed together and incubated at a temperature ranging from about 30° C. to about 60° C. for about 1 hour to about 14 days such that the backstaining is reduced and the contrast between blue and white fibers is increased.

13. The method according to claim 1, wherein the redeposition is reduced by about 5% when measured on the backside of the denim compared to a method wherein protease is not added.

14. The method according to claim 1, wherein the redeposition is reduced by about 10% when measured on the backside of the denim compared to a method wherein protease is not added.

15. A method for reducing or preventing backstaining during the stonewashing treatment of indigo-dyed denim comprising the steps of:

(a) substituting for or adding to pumice stones, or an equivalent abrasive substance, an effective amount of a redepositing cellulase and an added protease wherein the ratio of total protein of redepositing cellulase to total protein of added protease is from about 5 ppm: 1000 ppm to about 1000 ppm: 1 ppm; and (b) reducing or preventing backstaining wherein the contrast between white and blue is increased compared to indigo-dyed denim treated under the same conditions absent the added protease.

16. The method according to claim 15 wherein the redepositing cellulase is from Trichoderma.

17. The method according to claim 15 wherein the added protease is a serine protease.

18. The method according to claim 15 wherein the backstaining is reduced by 5% when measured on the backside of the denim compared to a method wherein the protease is not added.

19. The method according to claim 15 wherein the backstaining is reduced by 10% when measured on the backside of the denim compared to a method wherein the protease is not added.

20. The method according to claim 15 wherein said protease is added with the redepositing cellulose.

21. The method according to claim 15 wherein said protease is added after the redepositing cellulase.

* * * * *